US011128091B2

(12) United States Patent
Kobayashi et al.

(10) Patent No.: US 11,128,091 B2
(45) Date of Patent: Sep. 21, 2021

(54) LEVER-TYPE CONNECTOR

(71) Applicant: Yazaki Corporation, Tokyo (JP)

(72) Inventors: Tooru Kobayashi, Shizuoka (JP); Motoyoshi Suzuki, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/893,742

(22) Filed: Jun. 5, 2020

(65) Prior Publication Data

US 2020/0388961 A1 Dec. 10, 2020

(30) Foreign Application Priority Data

Jun. 7, 2019 (JP) ..... JP2019-106790

(51) Int. Cl.
*H01R 13/62* (2006.01)
*H01R 13/629* (2006.01)
*H01R 13/639* (2006.01)

(52) U.S. Cl.
CPC ..... *H01R 13/62938* (2013.01); *H01R 13/639* (2013.01)

(58) Field of Classification Search
CPC ..... H01R 13/62938; H01R 13/62933; H01R 13/631
USPC ..... 439/157, 372, 374
See application file for complete search history.

(56) References Cited

U.S. PATENT DOCUMENTS 6,602,082 B2 * 8/2003 Nishide ..... H01R 13/62938 439/157
6,805,564 B2 * 10/2004 Shinozaki ..... H01R 13/518 439/157
6,942,504 B2 * 9/2005 Shinozaki ..... H01R 13/62938 439/157
7,063,547 B2 * 6/2006 Toyoda ..... H01R 13/62911 439/157
7,063,548 B2 * 6/2006 Ohara ..... H01R 13/62938 439/157
7,172,442 B2 * 2/2007 Fukatsu ..... H01R 13/62938 439/157
7,189,086 B2 * 3/2007 Fukatsu ..... H01R 13/62938 439/157

(Continued)

FOREIGN PATENT DOCUMENTS

CN 107799960 A 3/2018
JP 2016-096107 A 5/2016

*Primary Examiner* — Thanh Tam T Le
(74) *Attorney, Agent, or Firm* — Sughrue Mion, PLLC

(57) ABSTRACT

A lever-type connector includes a mating housing having a cam boss, a housing fitted into and detached from the mating housing, a lever rotatably supported by the housing via a lever boss and rotating an operation unit to fit the both housings and a cable cover mounted to the rear of the housing and protecting a plurality of the cables pulled out from the rear of the housing. The lever has a temporary locking lock unit. The housing includes a temporary locking unit that temporarily locks the temporary locking lock unit, and a storage unit that stores the temporary locking lock unit in which the temporarily locked state with the temporary locking unit is released. The mating housing has a release unit that releases the temporarily locked state between the temporary locking lock unit and the temporary locking unit.

5 Claims, 12 Drawing Sheets

(56) References Cited

U.S. PATENT DOCUMENTS

| | | | | |
|---|---|---|---|---|
| 7,201,591 | B2 * | 4/2007 | Fujii | H01R 13/62938 439/157 |
| 7,270,553 | B2 * | 9/2007 | Matsubara | H01R 13/62955 439/157 |
| 7,300,294 | B2 * | 11/2007 | Fukatsu | H01R 13/62938 439/157 |
| 7,445,474 | B2 * | 11/2008 | Sakatani | H01R 13/62938 439/157 |
| 7,513,784 | B2 * | 4/2009 | Shibata | H01R 13/4538 439/157 |
| 7,524,200 | B2 * | 4/2009 | Ikeya | H01R 13/62938 439/157 |
| 7,641,486 | B2 * | 1/2010 | Tonosaki | H01R 13/62944 439/157 |
| 7,922,503 | B1 * | 4/2011 | Kobayashi | H01R 13/6295 439/157 |
| 7,959,451 | B2 * | 6/2011 | Tonosaki | H01R 13/62938 439/157 |
| 8,025,513 | B2 * | 9/2011 | Kobayashi | H01R 13/62966 439/157 |
| 8,684,756 | B2 * | 4/2014 | Kobayashi | H01R 13/6295 439/157 |
| 9,887,491 | B2 * | 2/2018 | Matsuura | H01R 13/62938 |
| 2006/0030186 | A1 | 2/2006 | Toyoda et al. | |
| 2006/0051994 | A1 | 3/2006 | Fujii | |
| 2016/0141798 | A1 | 5/2016 | Kawashima | |
| 2018/0069345 | A1 | 3/2018 | Shimizu et al. | |
| 2018/0069346 | A1 | 3/2018 | Shimizu et al. | |

* cited by examiner

LEVER-TYPE CONNECTOR

CROSS-REFERENCE TO RELATED APPLICATIONS

The present application is based on, and claims priority from Japanese Patent Application No. 2019-106790, filed on Jun. 7, 2019, the entire contents of which are incorporated herein by reference.

TECHNICAL FIELD

The present application relates to a lever-type connector in which both male and female housings are fitted and detached with low insertion force by operating a lever.

BACKGROUND

JP 2016-96107 A discloses a lever-type connector provided with a first connector housing having a lever support shaft and a lever temporary locking unit on a side surface, a second connector housing that has a temporary lock release unit in a hood unit and is a mating connector of the first connector housing, and a lever that is rotatably supported by the lever support shaft of the first connector housing and has a release force receiving piece on a lever body.

When the lever of such lever-type connector abuts the first connector housing and the second connector housing to a mating start position in a state in which a rotation start position is temporarily locked by a lever temporary locking unit of the first connector housing, the release force receiving piece of the lever rides on the temporary lock release unit of the second connector housing, and a temporarily locked state by the lever temporary locking unit is released.

Further, when the lever is rotated to a rotation end position, an operation unit of the lever functions as a leverage point, a pair of support holes functions as a point of action of the lever for applying force on the first connector housing, a housing action unit of the lever functions as a fulcrum of the lever for applying force to the second connector housing, and fitting between the first connector housing and the second connector housing is completed with small operation force (low insertion force).

SUMMARY

However, in such lever-type connector, when the lever is rotated at the time of releasing the temporarily locked state of the lever by the lever temporary locking unit of the first connector housing, there is a possibility that the second connector housing that is a mating connector may fall off from the first connector housing.

The present application has been made to solve the above-described problem, and an object of the present application is to provide a lever-type connector capable of simultaneously releasing a temporary lock of a lever and prevent a mating housing from falling off.

In the present application, a lever-type connector includes a mating housing having a cam boss, a housing fitted into and detached from the mating housing, a lever rotatably supported by the housing via a lever boss, having a cam groove to be engaged with the cam boss, and configured to fit the mating housing by pulling the mating housing toward the housing by engagement of the cam groove and the cam boss by rotating an operation unit, and a cable cover attached to a rear portion of the housing and configured to protect a plurality of cables pulled out from the rear portion of the housing The lever has a temporary locking lock unit. The housing has a temporary locking unit configured to temporarily lock the temporary locking lock unit, and a storage unit configured to store the temporary locking lock unit in which a temporarily locked state with the temporary locking unit is released. The mating housing includes a release unit configured to release the temporarily locked state between the temporary locking lock unit and the temporary locking unit.

According to the present application, since the lever has the temporary locking lock unit, the housing has the temporary locking unit that temporarily locks the temporary locking lock unit, and a storage unit that stores the temporarily locking lock unit released from the temporarily locked state with the temporary locking unit, and the mating housing has the temporary locking unit and the release unit that releases the temporarily locked state of the temporary locking unit, and therefore it is possible to simultaneously release temporary lock of the lever and prevent the mating housing from falling off.

DETAILED DESCRIPTION

Various embodiments will be described hereinafter with reference to the accompanying drawings.

Figure 1:
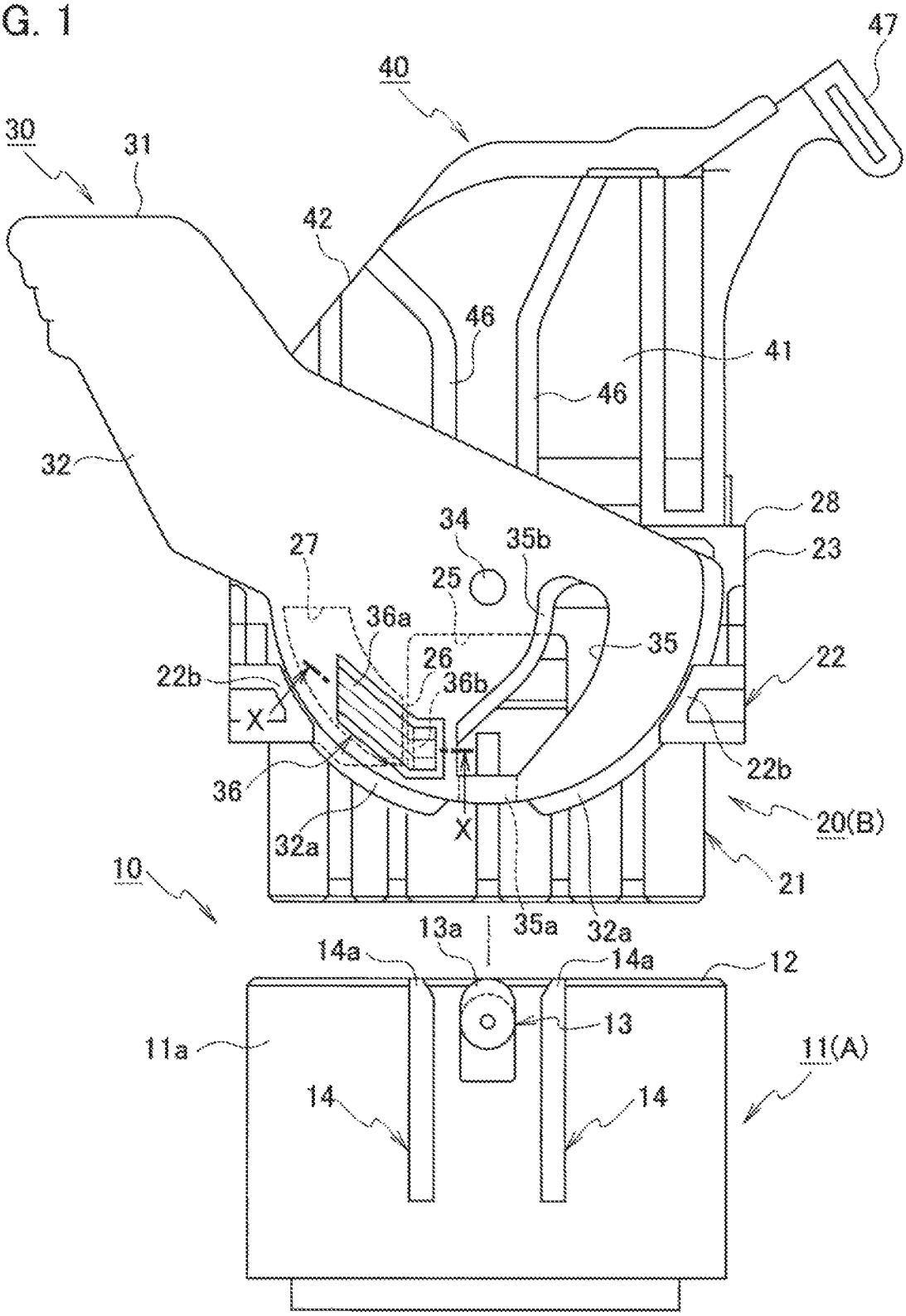
FIG. 1 is a side view illustrating a state before fitting a lever-type connector according to an embodiment of the present application.
Figure 11:
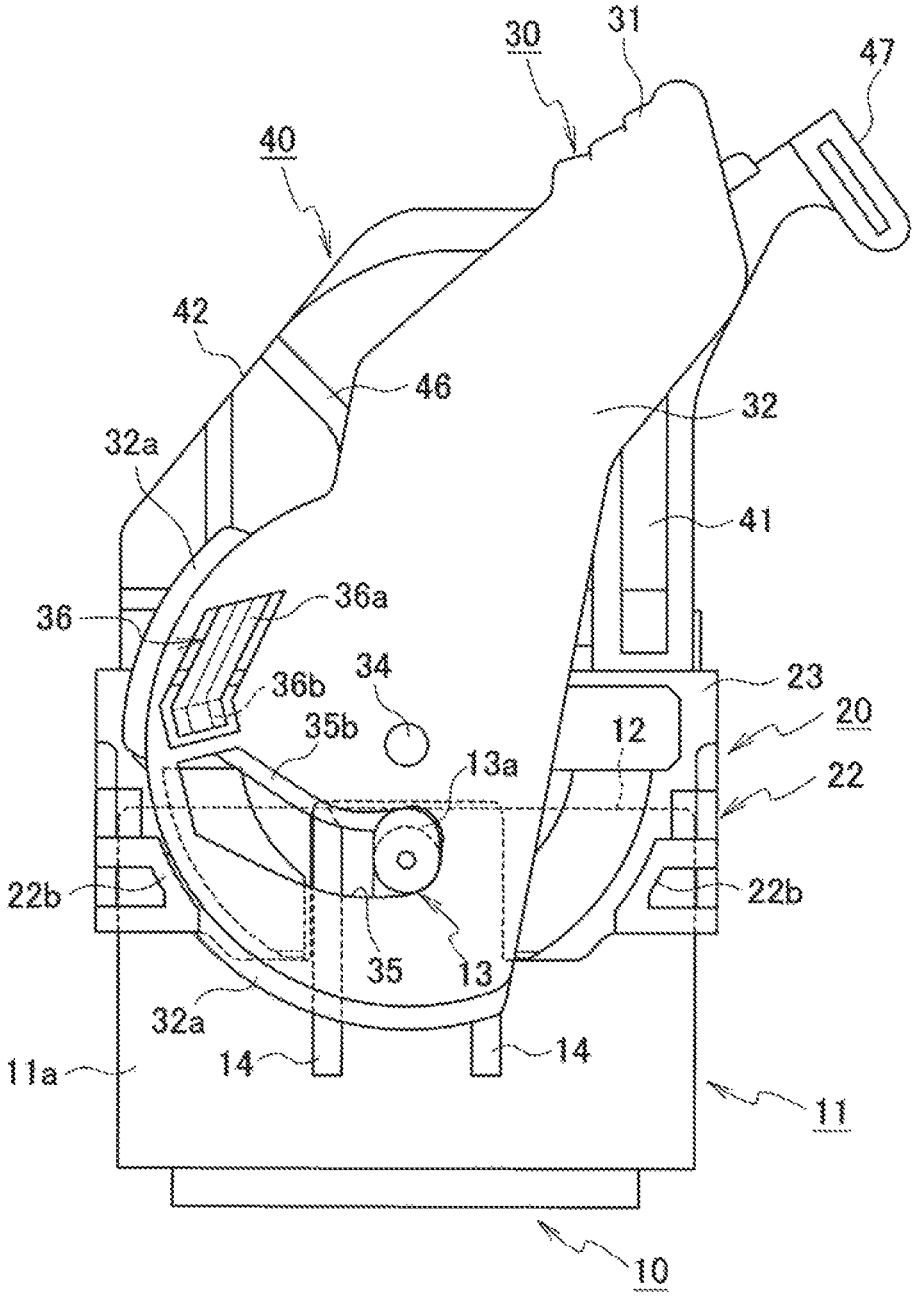
FIG. 11 is a side view illustrating a fitted state of the lever-type connector.
Figure 12:
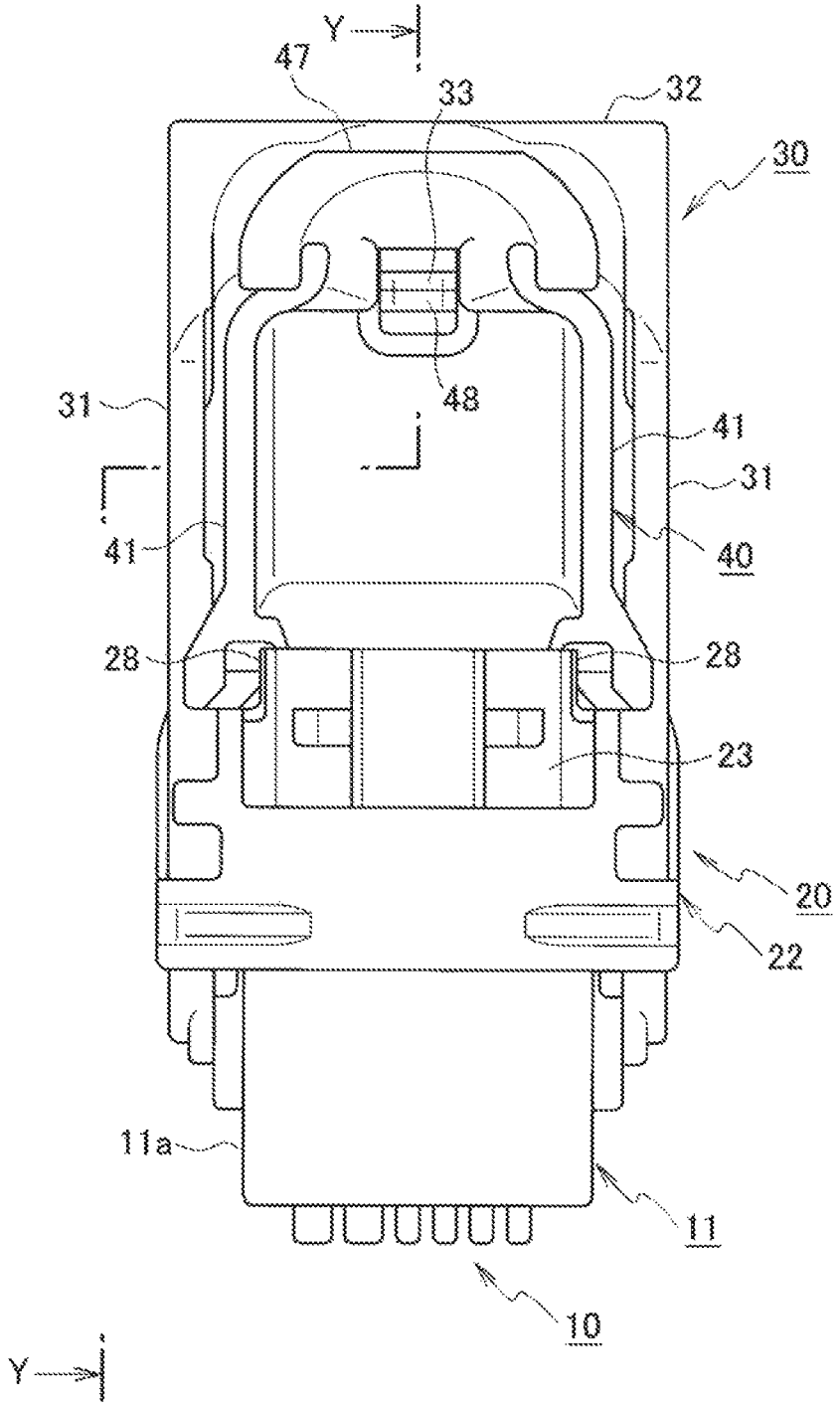
FIG. 12 is a front view illustrating a fitted state of the lever-type connector.

As illustrated in FIGS. 1 and 11, a lever-type connector 10 has a synthetic resin male housing (mating housing) 11 having a cam boss 13, a synthetic resin female housing 20 fitted into and detached from the male housing 11, and a cam groove 35, which is rotatably supported by a boss hole 24 provided in the female housing 20 via a lever boss 34 and engaged with the cam boss 13. The lever-type connector 10 further includes a synthetic resin lever 30 fitted into the male and female housings 11, 20 by rotating an operation unit 31 and pulling the male housings 11 toward the female housing 20 by engagement of the cam groove 35 and the cam boss 13, and a synthetic resin cable cover 40 that is attached to an assembling unit 28 at the rear of the female housing 20 and protects a plurality of cables 51 pulled out from the rear of the female housing 20. In FIG. 1, a vertical direction in the drawing where the male housing 11 and the female housing 20 are fitted and detached is defined as a fitting direction, a crosswise direction in the drawing where a direction perpendicular to the fitting direction and connecting lever temporary lock release ribs 14 each other so as to sandwich the cylindrical cam boss 13 in the male housing 11 is defined as a width direction, and a direction perpendicular to the fitting direction and the width direction and perpendicular to a paper of the drawing is defined as a thickness direction. Note that directions such as "front and rear" and "up and down" are determined for convenience of description, and do not restrict the actual mounting posture of each element.

As illustrated in FIG. 1, the male housing 11 has a hood unit 12 inserted into an outer cover 22 of the female housing 20 on the front side of the male housing 11 (the female housing 20 side in the fitting direction). Further, at the center in the width direction on the front side (the female housing 20 side in the fitting direction) of both side surfaces 11*a* and 11*a* (each side surface on one side and the other side in the thickness direction) of the male housing 11, the cylindrical cam bosses 13 are each integrally formed so as to protrude. Further, pairs of the lever temporary lock release ribs 14 and 14 are integrally formed so as to protrude on both side surfaces 11*a* and 11*a* of the male housing 11 so as to sandwich the cam boss 13 in the width direction. A tip 14*a* side of each lever temporary lock release rib 14 in the fitting direction is a release unit for releasing a temporarily locked state between each temporary locking lock unit 36 of a pair of arm units 32 and 32 of the lever 30 described later and a pair of temporary locking units 26 and 26 of the female housing 20. Inside the hood unit 12 of the male housing 11, a tab portion of a male terminal (not illustrated) is exposed.

As illustrated in FIGS. 2 to 5, the female housing 20 includes a block-shaped housing body 21 having a plurality of terminal housing chambers 21*a* for housing female terminals 50 to which the cables 51 are connected, an outer cover 22 which is formed integrally with the housing body 21 so as to protrude outward in the width direction of the center in the fitting direction and into which the hood unit 12 of the male housing 11 is fitted, and a quadrangular cylindrical portion 23 integrally formed at the rear of the housing body 21 (one side in the fitting direction (upper side in FIG. 1)).

On the side of the central cylindrical portion 23 in the width direction of both side surfaces 22*a* and 22*a* (each surface of one side and the other side in the thickness direction) of the outer cover 22 of the female housing 20, the boss holes 24 that rotatably support the lever boss 34 of the lever 30 are formed. At the center in the width direction of the front side (the male housing 11 side in the fitting direction) of both side surfaces 22*a* and 22*a* of the outer cover 22, rectangular notches 25 are each formed. On both sides in the width direction of each rectangular notch 25, rib-shaped temporary locking units 26 for temporarily locking the temporary locking lock unit 36 of the lever 30 are integrally formed so as to protrude. On the outside in the width direction of each temporary locking unit 26, a recessed lock storage unit 27 for storing the temporary locking lock unit 36 of the lever 30 released from the temporarily locked state with each temporary locking unit 26 is formed. On the rear end sides (one side in the fitting direction (upper side in FIG. 1)) of both side surfaces (each side surface on one side and the other side in the width direction) of the cylindrical portion 23 of the female housing 20, a pair of assembling units 28 and 28 for assembling the cable cover 40 is formed. Each of the assembling units 28 has a pair of protruding pieces 28*a* and 28*a* integrally formed on the rear end sides of both side surfaces of the cylindrical portion 23 and a pair of upright pieces 28*b* and 28*b*.

Figure 4:
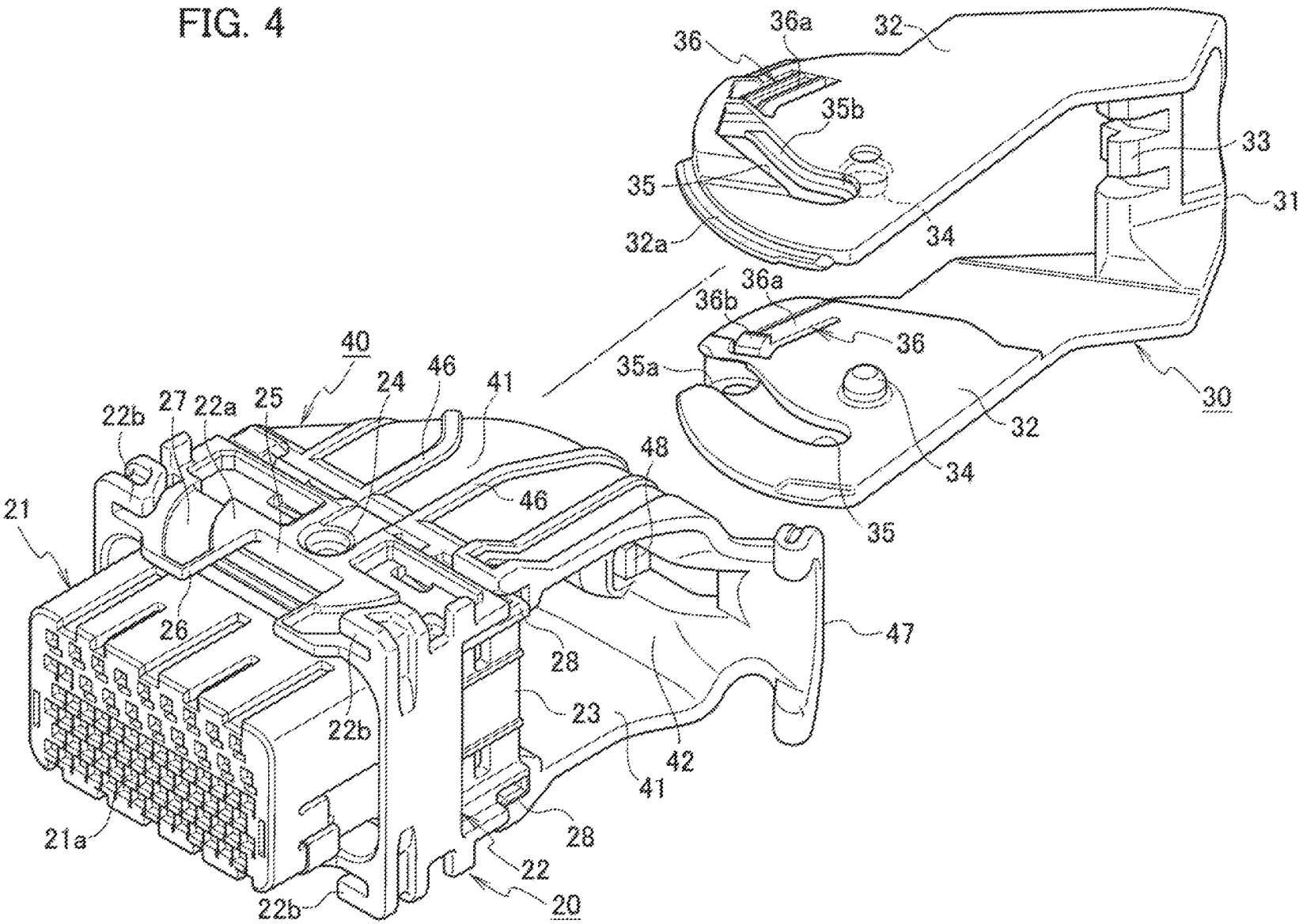
FIG. 4 is a perspective view illustrating a state before assembling a lever to the female housing.
Figure 5:
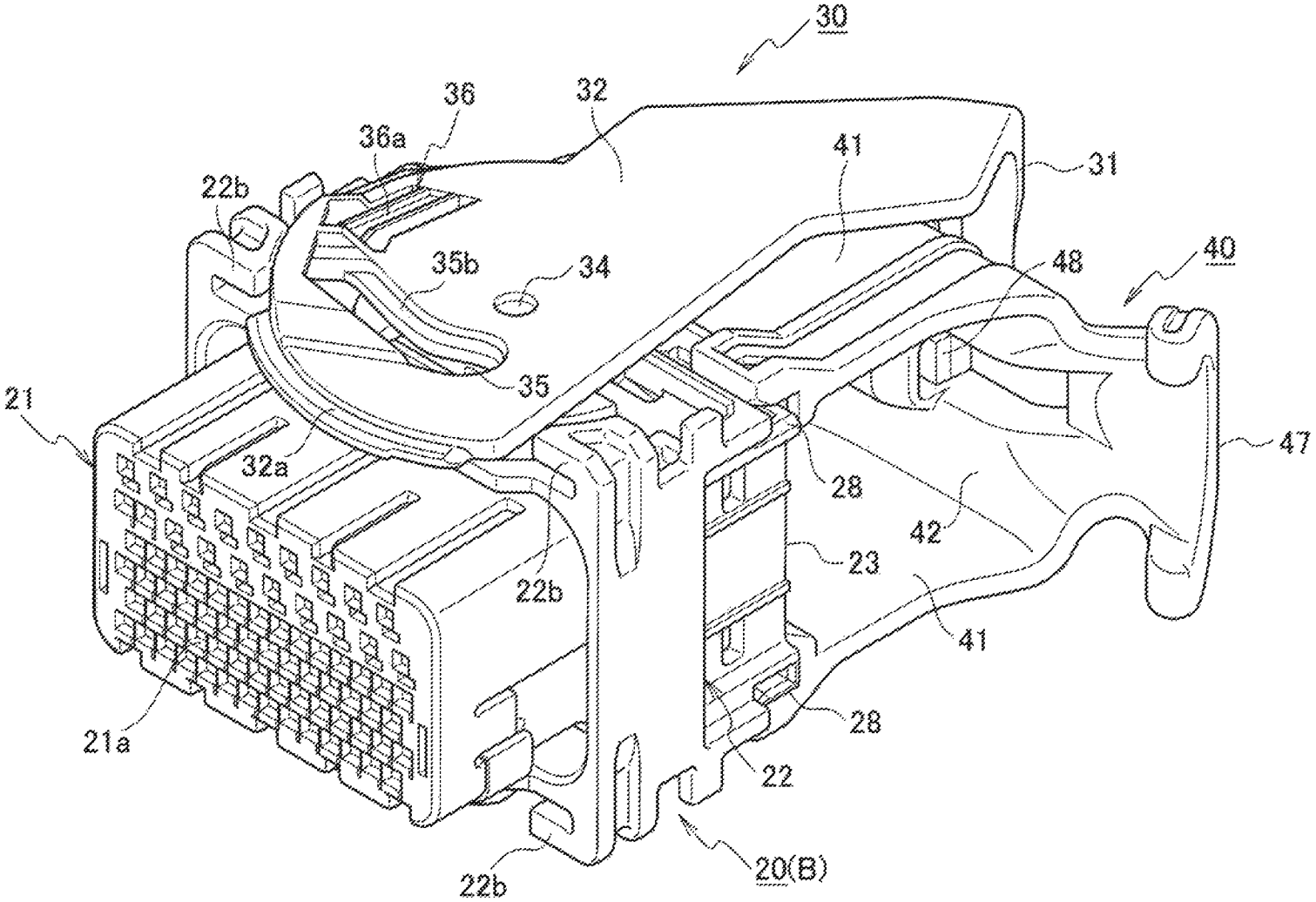
FIG. 5 is a perspective view illustrating a state where a cable cover and a lever are assembled to the female housing.

As illustrated in FIGS. 4 and 5, the lever 30 includes the operation unit 31 and the pair of the arm units 32 and 32 extending from both sides of the operation unit 31 (one side and the other side in the thickness direction with respect to the operation unit 31) and arranged on both side surfaces (each side surface on one side and the other side in the thickness direction) of the female housing 20.

Figure 13:
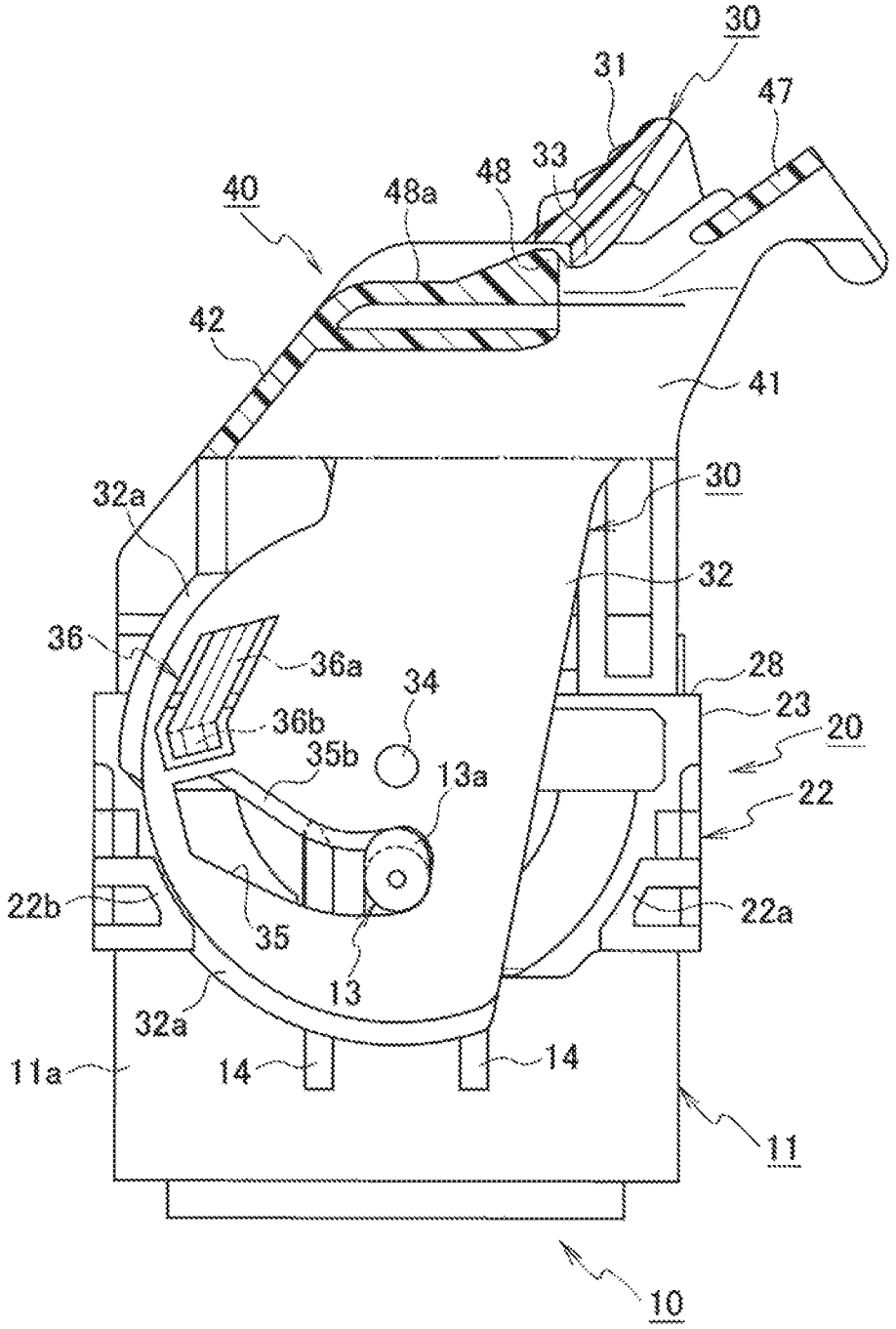
FIG. 13 is a sectional view taken along line Y-Y in FIG. 12.

As illustrated in FIG. 4, at the center in the thickness direction of the operation unit 31 of the lever 30, a lever lock unit 33 is provided for holding the lever 30 in a rotation restricted state when the rotation of the lever 30 is completed (when the male and female housings 11, 20 are fitted). The lever lock unit 33 is provided below the operation unit 31 (on the cable cover 40 side). As illustrated in FIG. 13, at a connector fitting completion position (lever forward operation completion position) of the operation unit 31 of the lever 30, the lever lock unit 33 is engaged to a cover lock unit 48 of the cable cover 40 described later.

Further, as illustrated in FIG. 4, each arm unit 32 of the lever 30 is protrudingly provided with the lever boss 34 rotatably supported by the boss holes 24 formed on both side surfaces (one side and the other side in the thickness direction) of the female housing 20. Each arm unit 32 has the cam groove 35 which is engaged with the cam boss 13 formed on the male housing 11. In addition, the male and female housings 11, 20 are fitted with low insertion force through the cam groove 35 and the cam boss 13 by a forward operation (operation in the direction indicated by arrow T in FIG. 9) of the operation unit 31 of the lever 30. The male housing 11 and the female housing 20 are detached with low insertion force by a backward operation of the operation unit 31 of the lever 30.

Further, as illustrated in FIG. 4, the temporary locking lock unit 36 is cut out at a position near an entrance 35*a* of the cam groove 35 of each arm unit 32 of the lever 30. The temporary locking lock unit 36 has a lock arm 36*a* that is elastically deformed, and a locking protrusion 36*b* that is formed integrally with the lock arm 36*a* and temporarily locked to the rib-shaped temporary locking unit 26 of the female housing 20.

As illustrated in FIGS. 2 to 5, the cable cover 40 is a member for protecting a mechanical load from acting on a plurality of the cables 51 pulled out from the cylindrical portion 23 at the rear (one side in the fitting direction (upper side in FIG. 1)) of the female housing 20. The cable cover 40 includes a pair of side walls 41 and 41 forming an opening, a curved ceiling wall 42 having a curved surface, and a housing contact wall 43 that covers one end on a narrow side of the pair of the side walls 41, 41. The cable cover 40 is formed so as to be mounted to the assembling unit 28 provided on the rear end side (one side in the fitting direction (upper side in FIG. 1)) of the cylindrical portion 23 of the female housing 20.

Figure 2:
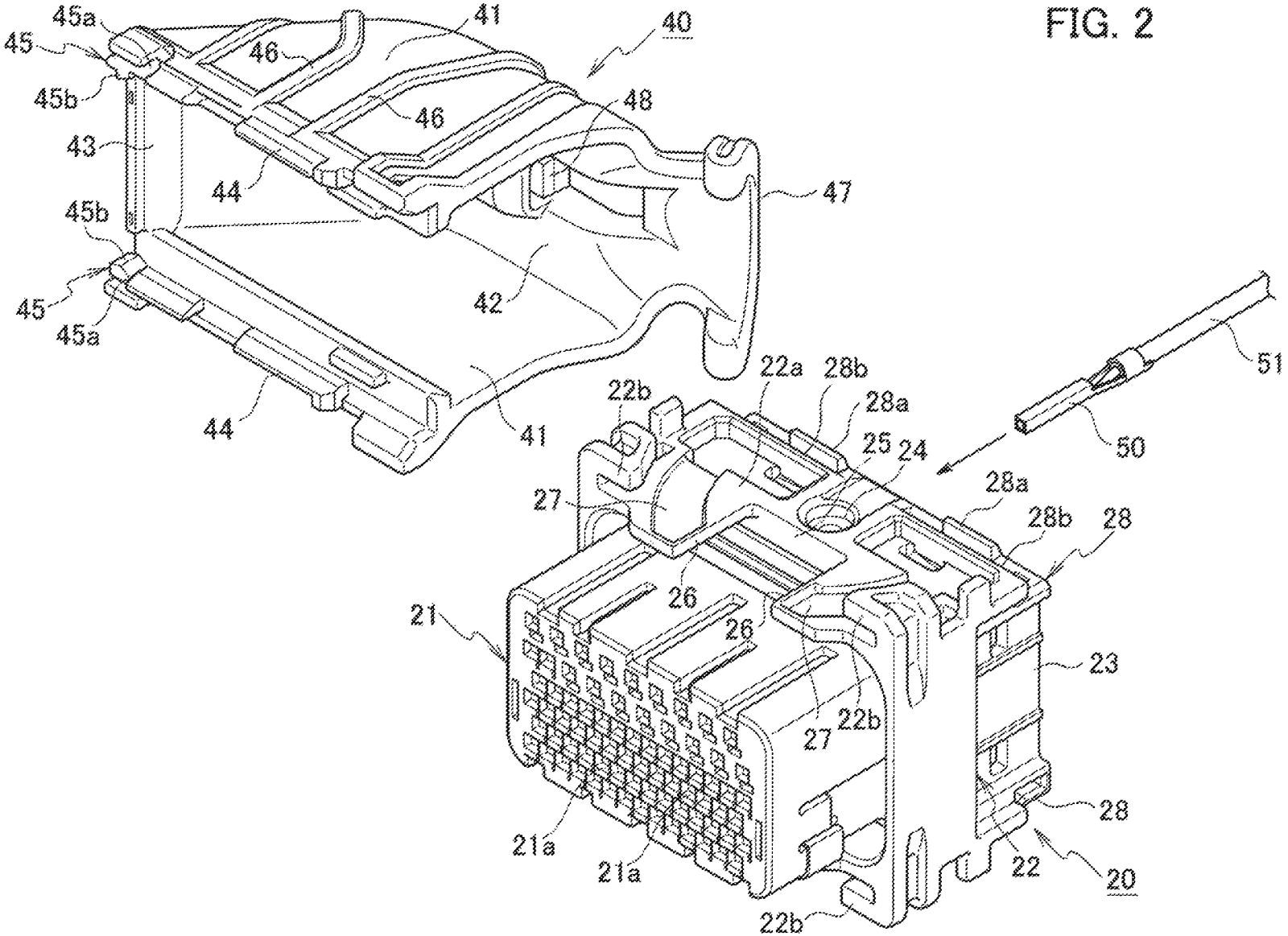
FIG. 2 is a perspective view illustrating a state before assembling a cable cover to a female housing of the lever-type connector.

As illustrated in FIG. 2, at a lower end (on the female housing 20 side in the fitting direction) of the side wall 41 of the cable cover 40, the slide ribs 44 are integrally formed so as to protrude, and the slide ribs 44 are slidably mounted between a pair of protruding pieces 28*a* and 28*a* and a pair of upright pieces 28*b* and 28*b* of the assembling unit 28 such that the slide ribs 44 can be prevented from coming off.

Further, as illustrated in FIG. 2, after the lower end side of the side wall 41 of the cable cover 40 slides between the protruding piece 28*a* and the upright piece 28*b* of the assembling unit 28 of the cylindrical portion 23 of the female housing 20, a lock protrusion 45*b* of an elastic lock piece 45 integrally formed at the lower end of the side wall 41 is locked with a recessed locked portion (not illustrated) formed on the cylindrical portion 23 of the female housing 20. The elastic lock piece 45 has a long lock arm 45*a* and the lock protrusion 45*b* integrally formed so as to protrude at the tip of the lock arm 45*a*.

Figure 3:
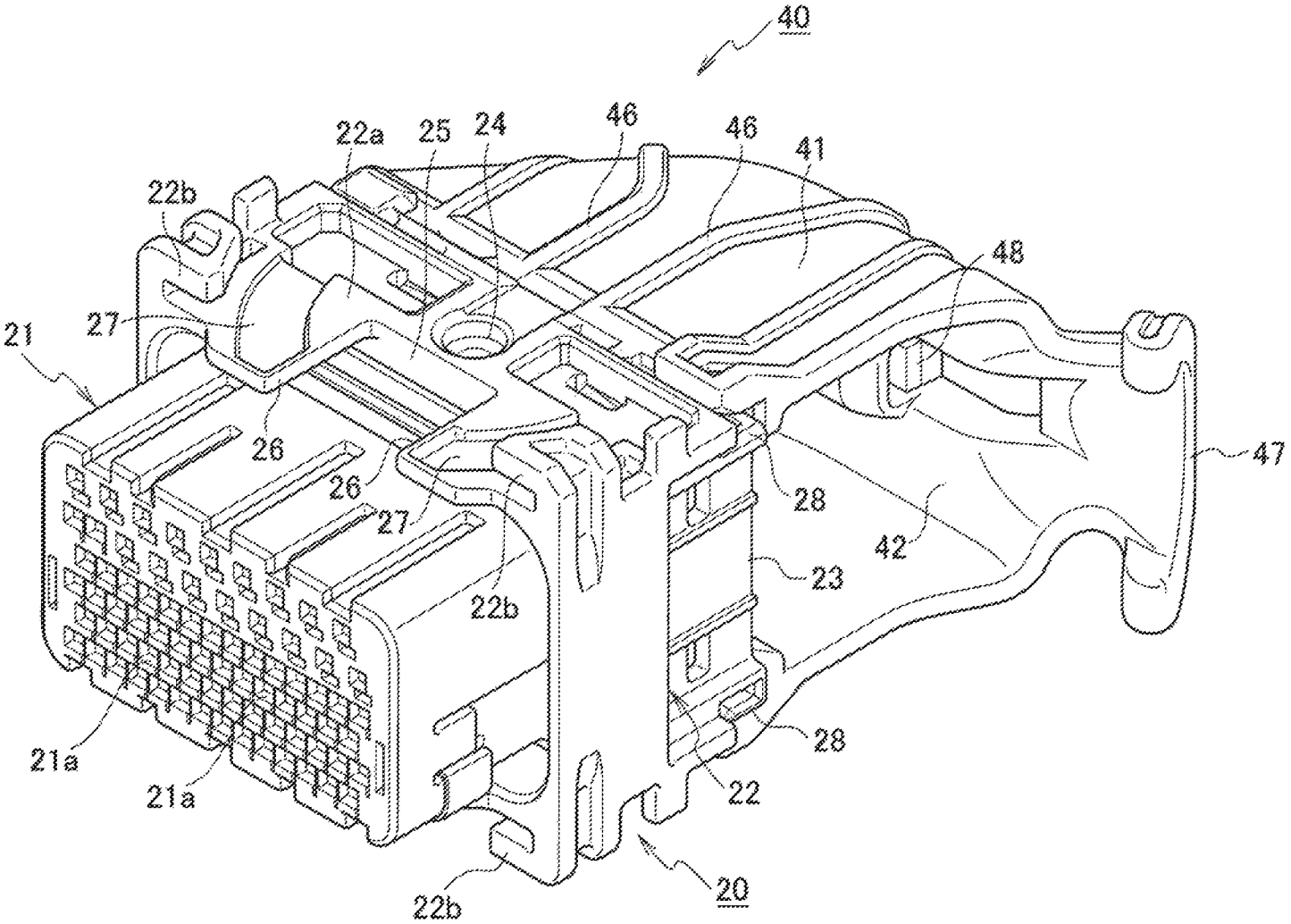
FIG. 3 is a perspective view illustrating a state where a cable cover is assembled to the female housing.

Further, as illustrated in FIGS. 2 to 4, the side wall 41 of the cable cover 40 has a pair of guide ribs 46 and 46 for guiding the lever boss 34 of the lever 30 to the boss hole 24 of the female housing 20. The pair of the guide ribs 46 and 46 is formed so as to gradually narrow and incline from the ceiling wall 42 side to the center in the fitting direction and to extend from the center to the slide rib 44 side in parallel with the fitting direction.

As illustrated in FIGS. 1 to 6, a cable holding unit 47 for holding a plurality of the cables 51 bundled and tape-wound is integrally formed so as to protrude in a U-shape on the tip side of the opening of the ceiling wall 42 of the cable cover 40. Further, as illustrated in FIGS. 4 and 13, the cover lock unit 48 which is locked to the lever lock unit 33 of the lever 30 is provided on the rear side of the cable holding unit 47 of the ceiling wall 42. The cover lock unit 48 is arranged at the tip of a lock arm 48*a* that is formed integrally with the ceiling wall 42 and elastically deforms.

As illustrated in FIGS. 2 to 4, in order that the lever 30 can be mounted from both sides of the front or rear side in the width direction of the cable cover 40 on both side surfaces (each side surface of one side and the other side in the thickness direction) of the female housing 20, a pair of a rib-shaped temporary locking unit 26 and the recessed lock storage unit 27 is formed on both left and right sides (one side and the other side in the width direction with respect to the boss hole 24) so as to sandwich the boss hole 24. The rib-shaped temporary locking unit 26 temporarily locks the temporary locking lock unit 36 of the lever 30. The recessed lock storage unit 27 stores the locking protrusion 36*b* of the temporary locking lock unit 36 of the lever 30 released from the temporarily locked state with each temporary locking unit 26.

Figure 6:
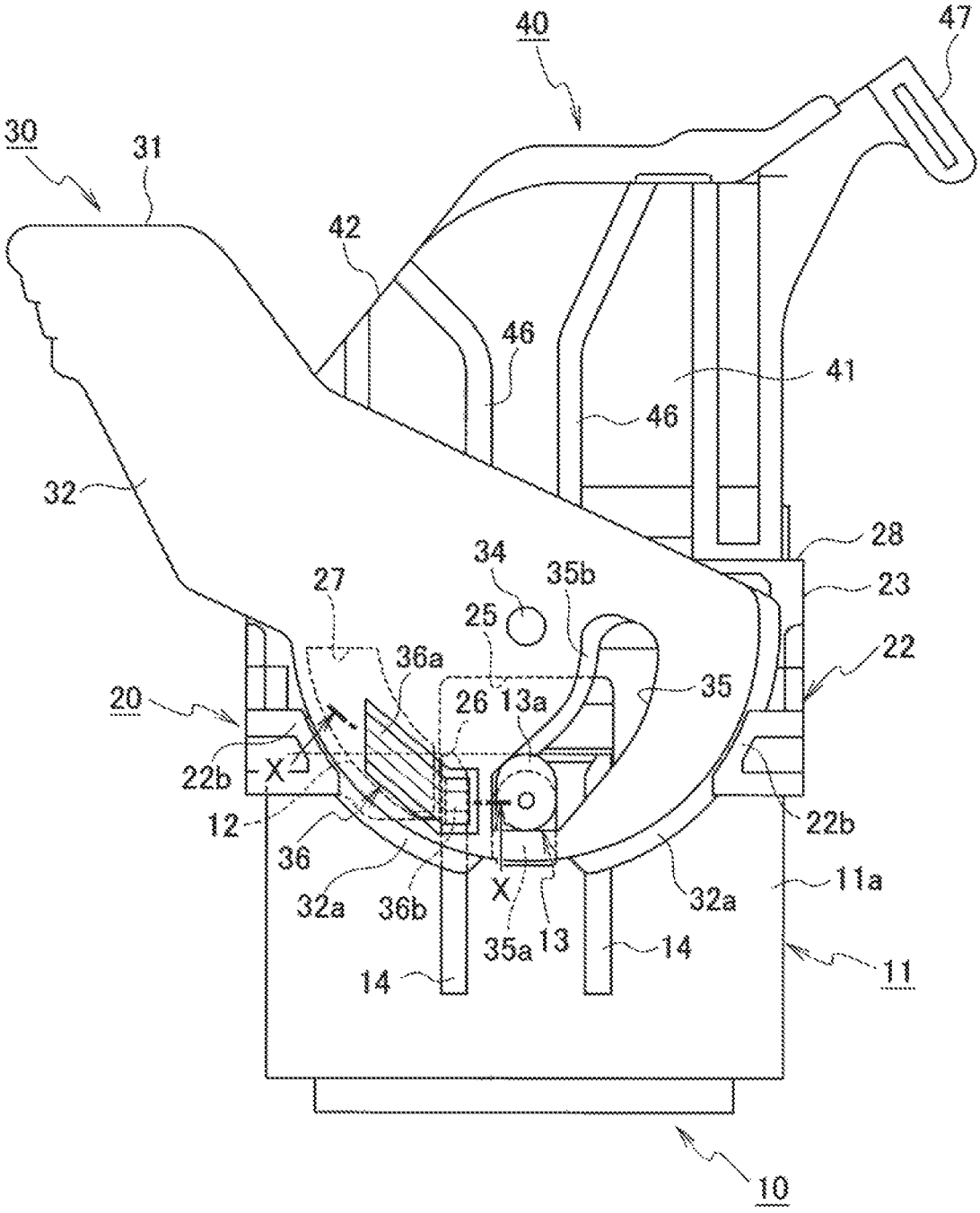
FIG. 6 is aside view illustrating a state when a temporary locking lock of the lever is released.

As illustrated in FIG. 1, at the upper end (one side and the other side in the thickness direction) of the cylindrical cam boss 13 provided on the male housing 11, an elliptical flange-shaped hook piece 13*a* is protrudingly provided. In addition, the cam boss 13 is formed not to be detached from the cam groove 35 when the hook piece 13*a* of this cam boss 13 moves by hooking on the guide rib 35*b* protrudingly formed in one arc portion of the cam groove 35 of the lever 30. Further, as illustrated in FIGS. 1 and 6, a pair of thin and arcuate engagement pieces 32*a* and 32*a* is protrudingly provided on the tip side of the arm unit 32 of the lever 30. Then, as illustrated in FIG. 6, when the temporary locking lock of the lever 30 is released, the hook piece 13*a* of the cam boss 13 of the male housing 11 is hooked on the guide rib 35*b* of the cam groove 35 of the lever 30, the pair of the engagement pieces 32*a*, 32*a* of the lever 30 is engaged with a pair of locking pieces 22*b* and 22*b* protrudingly provided in an L-shape from both sides in the width direction of the outer cover 22 of the female housing 20, the male housing 11 and the lever 30 are formed not to come off from the female housing 20 side.

According to the lever-type connector 10 of the above-described embodiment, in the case of assembling a female connector B, first, as illustrated in FIG. 2, the female terminal 50 to which the cable 51 is connected is inserted into the terminal housing chamber 21*a* of the housing body 21 of the female housing 20 (terminal insertion step). At this time, since the lever 30 is not assembled to the female housing 20, high terminal insertion workability is obtained.

Next, as illustrated in FIG. 3, the cable cover 40 is assembled to the female housing 20 in which the female terminal 50 is inserted into the terminal housing chamber 21*a* (cover assembling step). At this time, since the lever 30 is not assembled to the female housing 20, high cover assembling workability is obtained.

As illustrated in FIGS. 4 and 5, the lever boss 34 of the lever 30 is fitted into the boss hole 24 of the female housing 20, and the lever 30 is mounted on the female housing 20 (lever assembling step). At this time, the lever boss 34 of the lever 30 is guided between the pair of the guide ribs 46 and 46 provided on the side wall 41 of the cable cover 40, and the lever boss 34 is inserted into the boss hole 24 without contacting a protrusion or the like formed on the female housing 20. As a result, the lever 30 can be easily assembled. Then, the female connector B in an assembled state illustrated in FIGS. 1 and 5 and a male connector A including the male housing 11 and the like illustrated in FIG. 1 are shipped to a vehicle assembling factory or the like in a separated state without fitting.

Figure 7:
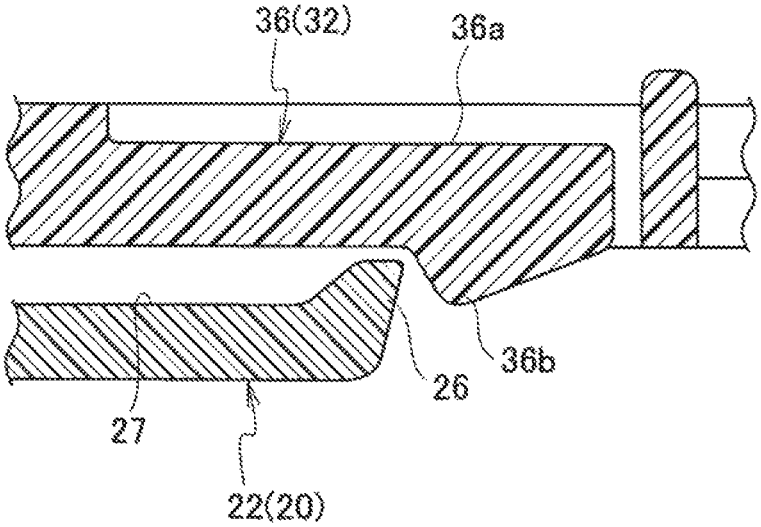
FIG. 7 is a sectional view taken along line X-X in FIG. 1.
Figure 8:
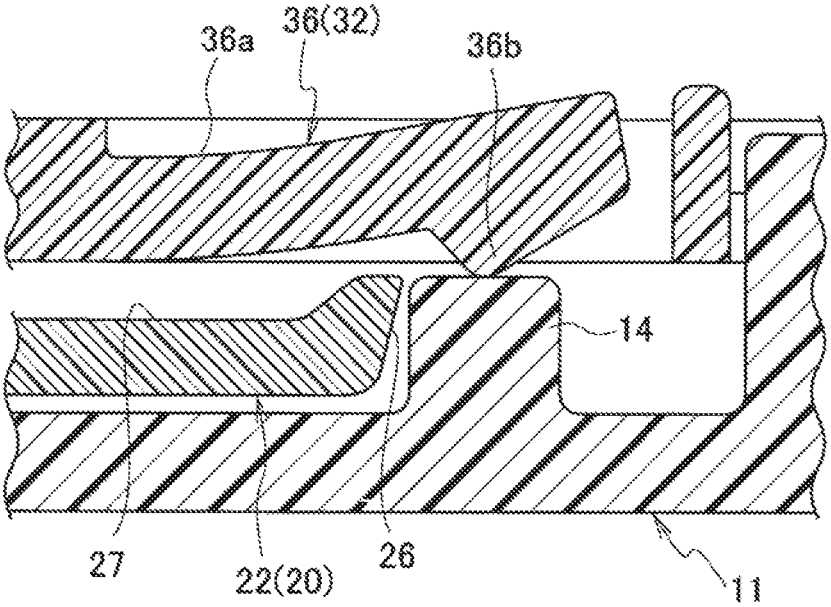
FIG. 8 is a sectional view taken along line X-X in FIG. 6.

As illustrated in FIGS. 1 and 7, in a state before fitting the male housing 11 and the female housing 20 of the lever-type connector 10 are fitted each other, the locking protrusion 36*b* of the temporary locking lock unit 36 of the lever 30 is temporarily locked to the rib-shaped temporary locking unit 26 of the female housing 20. From this state, as illustrated in FIG. 6, when the hood unit 12 of the male housing 11 is fitted between the housing body 21 and the outer cover 22 of the female housing 20, as illustrated in FIGS. 6 and 8, the tip 14*a* side of the male housing 11 in the fitting direction of the lever temporary lock release rib 14 abuts against the locking protrusion 36*b* of the temporary locking lock unit 36 of the lever 30, and when the lock arm 36*a* of the temporary locking lock unit 36 bends outward (one side and the other side in the thickness direction), the temporarily locked state between the locking protrusion 36*b* of the temporary locking lock unit 36 of the lever 30 and the rib-shaped temporary locking unit 26 of the female housing 20 is released.

Figure 9:
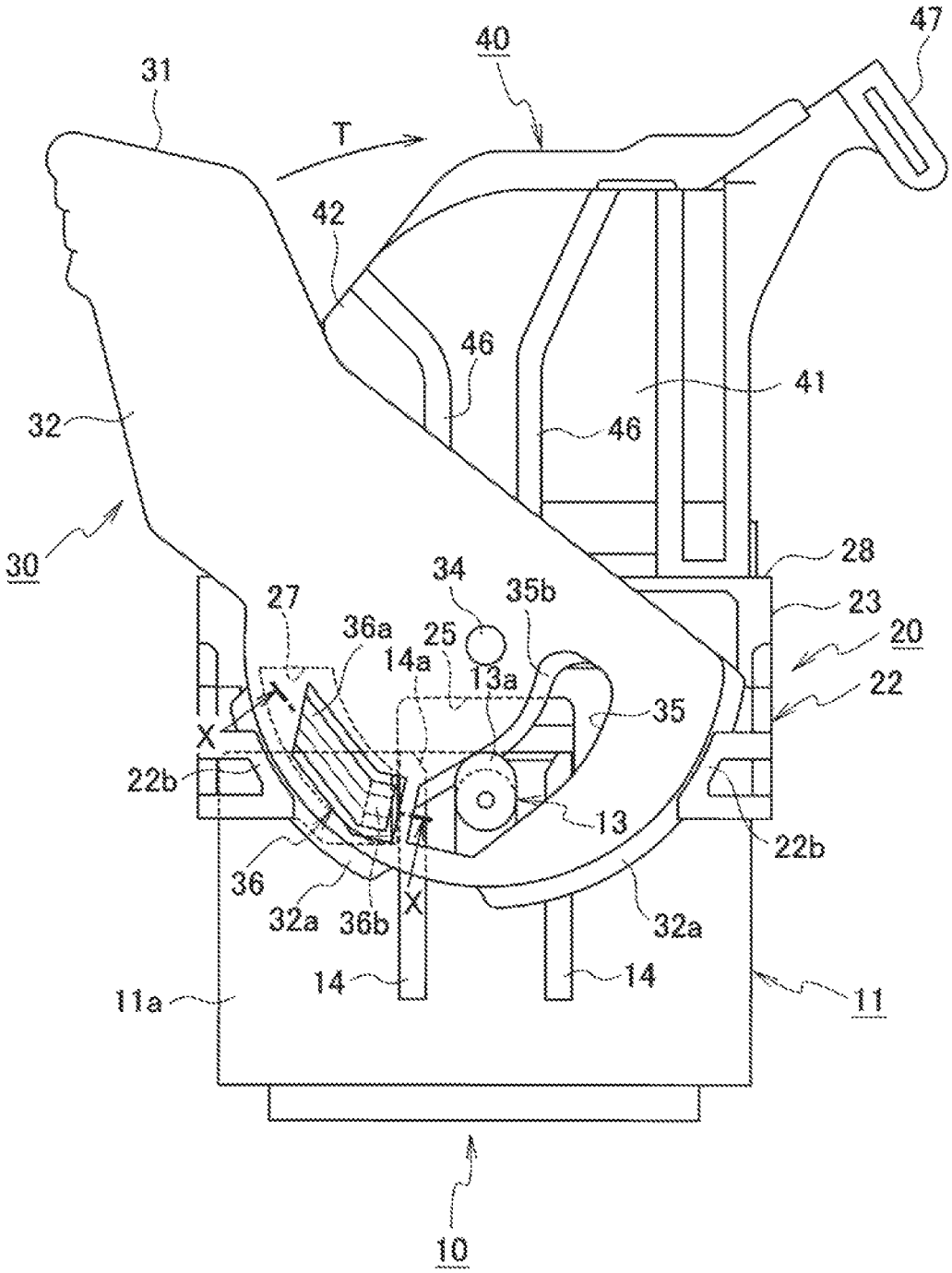
FIG. 9 is a side view illustrating a state where a temporary locking lock unit of the lever is dropped into a lock storage unit of the female housing.
Figure 10:
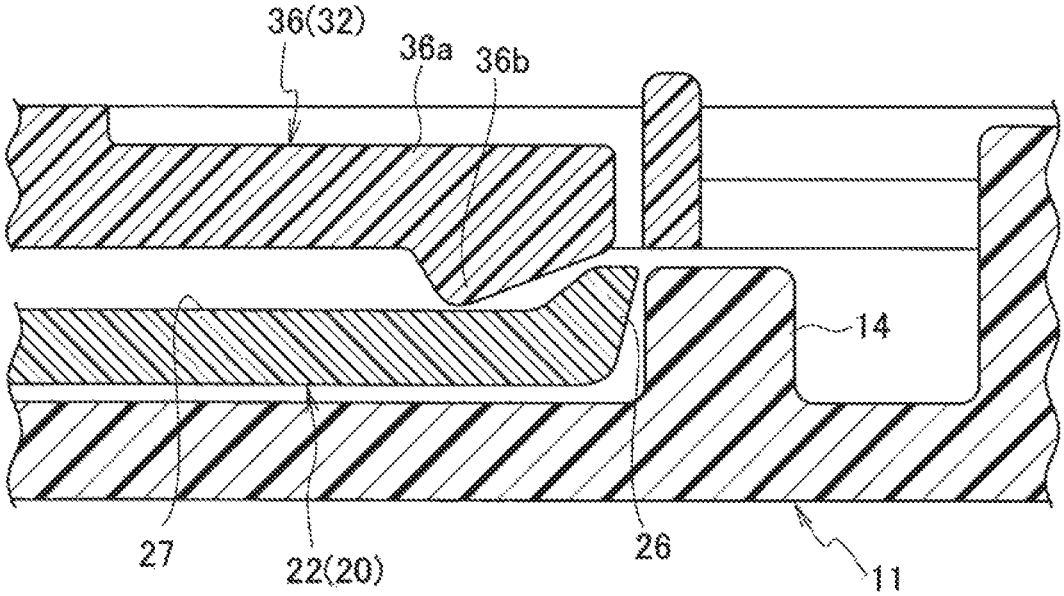
FIG. 10 is a sectional view taken along line X-X in FIG. 9.

Then, as illustrated in FIG. 9, when the hood unit 12 of the male housing 11 is further pushed into the depth between the housing body 21 and the outer cover 22 of the female housing 20 by inertia force, as illustrated in FIG. 10, the locking protrusion 36*b* of the temporary locking lock unit 36 of the lever 30 falls into the lock storage unit 27 of the female housing 20. Therefore, the lever 30 is in a state of not moving in a backward operation direction (the direction opposite to the forward operation direction T indicated in FIG. 9). At this time, as illustrated in FIG. 9, since the hook piece 13*a* of the cam boss 13 of the male housing 11 is hooked on the guide rib 35*b* of the cam groove 35 of the lever 30 and does not come off from the cam groove 35, the cam groove 35 of the lever 30 does not come off from the cam boss 13 of the male housing 11, and the cam boss 13 can be easily pulled into the cam groove 35. In this manner, the temporary release of the lever 30 and the prevention of the male housing 11 from falling off can be performed at the same time, and the lever fitting operation can be performed without the lever 30 coming off from the male housing 11.

Next, a comparative example will be described. In the lever 7 of the lever-type connector 1 according to the comparative example, in a state where a rotation start position is temporarily locked by the lever temporary locking unit 4 of the first connector housing 2, when the first connector housing 2 and the second connector housing 5 abut against a fitting start position, the temporarily locked state by the lever temporary locking unit 4 is released when the release force receiving piece g of the lever 7 rides on the temporary lock release unit 6 of the second connector housing 5.

Further, when the lever 7 is rotated to a rotation end position, an operation unit of the lever 7 functions as a leverage point, a pair of support holes 7*c* and 7*c* functions as a point of action of the lever for applying force on the first connector housing 2, a housing action unit 9 of the lever 7 functions as a fulcrum of the lever for applying force to the second connector housing 5, and fitting between the first connector housing 2 and the second connector housing 5 is completed with small operation force (low insertion force).

However, in the lever-type connector 1 according to the comparative example, when the lever 7 is rotated at the time of releasing the temporarily locked state of the lever 7 by the lever temporary locking unit 4 of the first connector housing 2, there is a possibility that the second connector housing 5 that is a mating connector may fall off from the first connector housing 2.

According to the above-described embodiment, the lever is mounted on the female housing from the front side of the cable cover. However, the lever may be mounted on the female housing from the rear side of the cable cover.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A lever-type connector comprising:

a mating housing having a cam boss;

a housing fitted into and detached from the mating housing;

a lever rotatably supported by the housing via a lever boss, having a cam groove to be engaged with the cam boss, and configured to fit the mating housing by pulling the mating housing toward the housing by engagement of the cam groove and the cam boss by rotating an operation unit; and a cable cover attached to a rear portion of the housing and configured to protect a plurality of cables pulled out from the rear portion of the housing, wherein the lever has a temporary locking lock unit, the housing has a temporary locking unit configured to temporarily lock the temporary locking lock unit, and a storage unit configured to store the temporary locking lock unit in which a temporarily locked state with the temporary locking unit is released to prevent the lever from moving in a backward operation direction, and the mating housing comprises a release unit configured to release the temporarily locked state between the temporary locking lock unit and the temporary locking unit.

2. The lever-type connector according to claim 1, wherein the temporary locking unit and the storage unit each comprises two temporary locking units and two storage units, respectively, the two temporary locking units and two storage units disposed on both sides of the housing, the lever has the operation unit and a pair of arm units extending from both sides of the operation unit and arranged on the both side surfaces of the housing, and the pair of the arm units each has the temporary locking lock unit.

3. The lever-type connector according to claim 2, wherein on each side surface, the mating housing has the release unit configured to release the temporarily locked state between each temporary locking lock unit of the pair of the arm units and the pair of the temporary locking units so as to sandwich the cam boss.

4. The lever-type connector according to claim 1, wherein the cam boss has a hook piece, and the cam groove has a guide rib configured to hook the hook piece.

5. The lever-type connector according to claim 3, wherein the cam boss has a hook piece, and the cam groove has a guide rib configured to hook the hook piece.

* * * * *